US007925180B2

(12) United States Patent
Mori et al.

(10) Patent No.: US 7,925,180 B2
(45) Date of Patent: Apr. 12, 2011

(54) IMAGE FORMING APPARATUS, IMAGE FORMATION PROCESS UNIT, AND DEVELOPING UNIT

(75) Inventors: Hiroki Mori, Nagoya (JP); Mitsuru Horinoe, Aichi-ken (JP); Yukiko Nakaya, Konan (JP); Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1098 days.

(21) Appl. No.: 11/535,555

(22) Filed: Sep. 27, 2006

(65) Prior Publication Data

US 2007/0071491 A1 Mar. 29, 2007

(30) Foreign Application Priority Data

Sep. 28, 2005 (JP) ..... 2005-281146

(51) Int. Cl.
*G03G 15/08* (2006.01)

(52) U.S. Cl. ..... 399/103; 399/222

(58) Field of Classification Search ..... 399/103, 399/222

See application file for complete search history.

(56) References Cited

U.S. PATENT DOCUMENTS

| | | | | |
|---|---|---|---|---|
| 5,502,547 | A * | 3/1996 | Shirai | 399/102 |
| 6,094,550 | A * | 7/2000 | Kido et al. | 399/103 |
| 6,181,897 | B1 * | 1/2001 | Kawai | 399/103 |
| 6,185,392 | B1 * | 2/2001 | Hoshi | 399/102 |
| 6,205,304 | B1 * | 3/2001 | Kawaguchi | 399/103 |
| 6,321,050 | B1 * | 11/2001 | Sato et al. | 399/103 |
| 6,336,014 | B1 * | 1/2002 | Sato et al. | 399/103 |
| 6,341,206 | B1 * | 1/2002 | Yamaguchi et al. | 399/103 |
| 6,356,723 | B1 * | 3/2002 | Sato et al. | 399/103 |
| 6,487,383 | B2 * | 11/2002 | Buchanan et al. | 399/103 |
| 6,496,668 | B2 * | 12/2002 | Sato et al. | 399/103 |
| 6,496,669 | B2 * | 12/2002 | Sato et al. | 399/103 |
| 6,505,020 | B1 * | 1/2003 | Higeta et al. | 399/109 |
| 6,735,404 | B2 * | 5/2004 | Higeta et al. | 399/109 |
| 6,853,832 | B2 * | 2/2005 | Noya et al. | 399/328 |
| 6,970,667 | B2 * | 11/2005 | Watanabe et al. | 399/104 |
| 7,283,765 | B2 * | 10/2007 | Uratani et al. | 399/104 |
| 7,324,775 | B2 * | 1/2008 | Okamoto | 399/103 |
| 7,471,921 | B2 * | 12/2008 | Fuwazaki et al. | 399/284 |
| 7,483,646 | B2 * | 1/2009 | Ueno et al. | 399/102 |
| 7,630,666 | B2 * | 12/2009 | Nakaya et al. | 399/103 |

(Continued)

FOREIGN PATENT DOCUMENTS

EP 890886 A1 * 1/1999

(Continued)

OTHER PUBLICATIONS

English translation of Kamimura (JP pub 2001-281992).*

(Continued)

*Primary Examiner* — David M Gray
*Assistant Examiner* — Geoffrey T Evans
(74) *Attorney, Agent, or Firm* — Banner & Witcoff, Ltd.

(57) ABSTRACT

An image forming apparatus includes a main body, image formation units disposed in the main body, a moving member disposed in the main body, the moving member including a surface facing each image formation unit, a pair of first stoppers disposed in each image formation unit, and a pair of second stoppers disposed in the main body in correspondence with each image formation unit, each second stopper being configured to prevent the developer on the moving member from entering the image formation unit.

17 Claims, 8 Drawing Sheets

U.S. PATENT DOCUMENTS

| | | | | |
|---|---|---|---|---|
| 7,643,771 | B2 * | 1/2010 | Fukuta | 399/103 |
| 7,831,170 | B2 * | 11/2010 | Hasegawa | 399/106 |
| 2002/0001489 | A1 * | 1/2002 | Ozaki et al. | 399/298 |
| 2002/0141777 | A1 * | 10/2002 | Kamimura et al. | 399/103 |
| 2003/0152396 | A1 * | 8/2003 | Yasui et al. | 399/103 |
| 2003/0170046 | A1 * | 9/2003 | Sato et al. | 399/109 |
| 2005/0095030 | A1 * | 5/2005 | Foster et al. | 399/103 |
| 2005/0141925 | A1 * | 6/2005 | Kim et al. | 399/281 |
| 2005/0158070 | A1 * | 7/2005 | Ishii | 399/103 |
| 2005/0191083 | A1 * | 9/2005 | Ueno et al. | 399/103 |
| 2006/0072934 | A1 * | 4/2006 | Fukuta | 399/103 |
| 2007/0071488 | A1 * | 3/2007 | Kamimura | 399/103 |
| 2008/0056774 | A1 * | 3/2008 | Mori et al. | 399/284 |

FOREIGN PATENT DOCUMENTS

| | | | |
|---|---|---|---|
| JP | 62-192769 | A | 8/1987 |
| JP | 2001-005287 | A | 1/2001 |
| JP | 2001-060040 | A | 3/2001 |
| JP | 2001-134079 | A | 5/2001 |
| JP | 2001-281992 | A | 10/2001 |

OTHER PUBLICATIONS

English translation of Kamimura (JP pub 2001-005287).*

* cited by examiner

IMAGE FORMING APPARATUS, IMAGE FORMATION PROCESS UNIT, AND DEVELOPING UNIT

This application claims priority from Japanese Patent Application No. 2005-281146 filed on Sep. 28, 2005, the entire subject matter of which is incorporated herein by reference.

FIELD OF THE INVENTION

Aspects of the invention relate to image forming apparatuses configured to form images on a recording medium using a powder-type developer.

BACKGROUND

A developing unit is contained in image forming apparatuses. The developing unit contains powder-type developer or toner. A developing roller is rotatably supported in a body casing of the developing unit. The developing roller is configured to have a cylindrical shape and hold the developer on a circumferential surface thereof. The developing roller is disposed such that a part of the circumferential surface is exposed external to the developing unit across its full length.

The developing unit is configured to develop an electrostatic latent image formed on a circumferential surface of a photosensitive member by facing the circumferential surface of the developing roller and the circumferential surface of the photosensitive member while rotating the developing roller.

A developing unit configured to be received in and removed from a main body of the image forming apparatus (or a developer cartridge) is known. As to the developer cartridge, disclosed are various kinds of configurations to prevent leakage of the developer from a gap between each end portion of the developing roller and the opening during the rotation of the developing roller.

For example, Japanese Laid-Open Patent Publication No. 2001-5287 discloses a developing unit in which side seals are provided to prevent leakage of the developer. The side seals are disposed to slidingly contact both ends of the circumferential surface of the developing roller, thereby preventing the developer from leaking from the gaps between each end of the developing roller and the opening.

Japanese Laid-Open Patent Publication No. 2001-60040 (corresponding to U.S. Pat. Nos. 6356723 B1 and 6496669 B2) discloses a developing cartridge in which safeguard members are provided in addition to the side seals. The safeguard members are disposed on both ends of the opening in which the developing roller is rotatably disposed, with respect to its length. According to this configuration, if a small amount of developer leaks from a sliding portion between each end portion of the developing roller and the side seal, the developer can be received by the safeguard member and thus prevented from leaking outside the developer cartridge.

SUMMARY

Aspects of the invention provide a color image forming apparatus that can prevent a chain reaction of sealing defects between developing units, an image formation process unit used for an image formation process in the image forming apparatus, and the developing units used for developing process in the image forming apparatus.

BRIEF DESCRIPTION OF THE DRAWINGS

Aspects of the invention will be described in detail with reference to various example structures and the following figures, wherein.

DETAILED DESCRIPTION

A first example according to aspects of the invention will be described with reference to the accompanying drawings.

Figure 1:
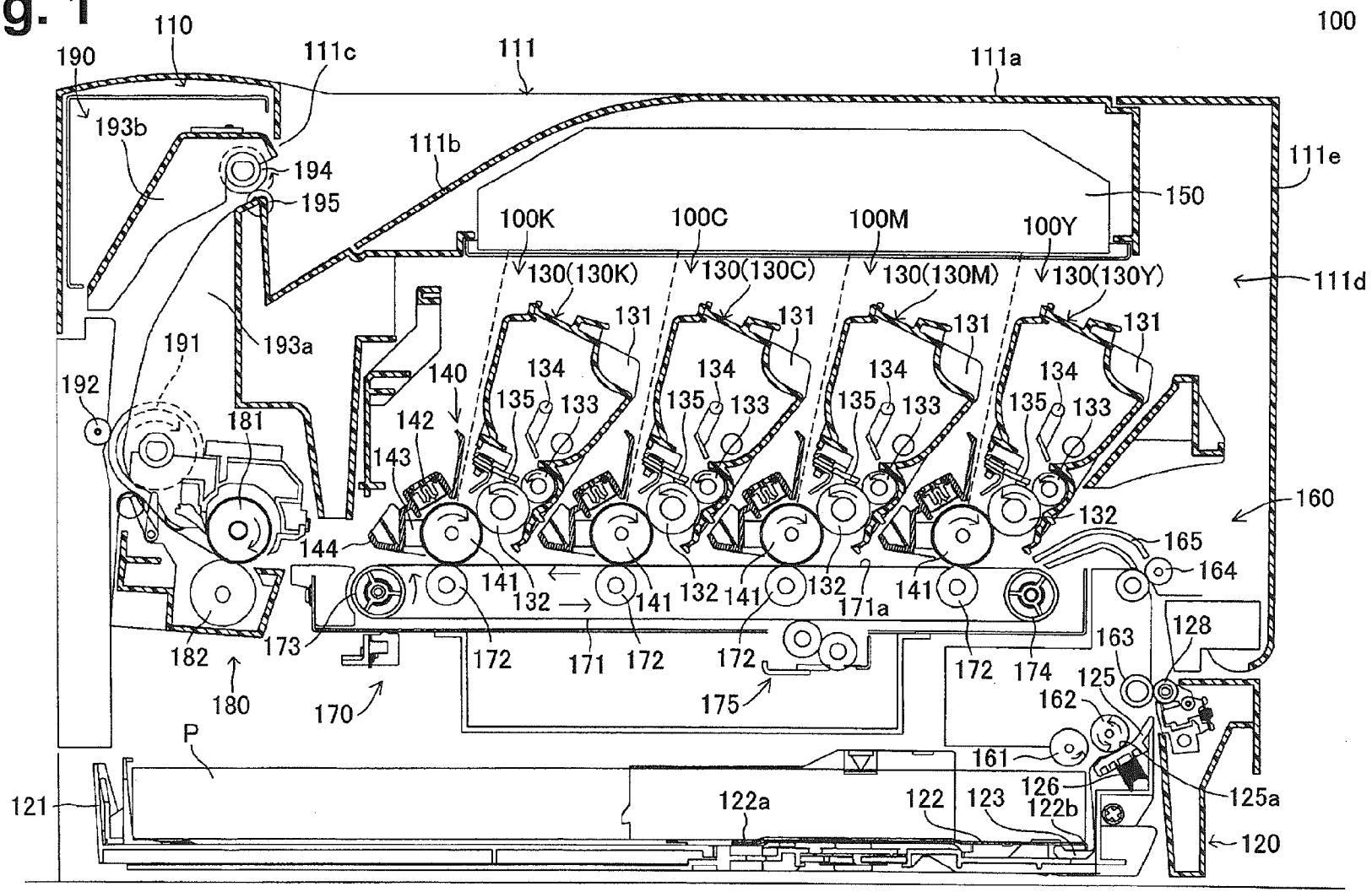
FIG. 1 is a sectional view showing an internal structure of a color laser printer according to an illustrative aspect of the invention.

A brief overview of a configuration of a color laser printer 100 will be described with reference to FIG. 1. In FIG. 1, a right side is referred to as a front side of the color laser printer 100, and a left side is referred to as a back side of the color laser printer 100. In addition, a direction from the top to the bottom is referred to as a height direction or vertical direction of the laser printer 100, a direction from the right to the left is referred to as a front-back direction of the color laser printer 100, and a direction perpendicular to the sheet of FIG. 1 is referred to as a width direction of the color laser printer 100.

In the color laser printer 100, a yellow image formation portion 100Y, a magenta image formation portion 100M, a cyan image formation portion 100C, and a black image formation portion 100K are accommodated in a main body 110. The yellow image formation portion 100Y, the magenta image formation portion 100M, the cyan image formation portion 100C, and the black image formation portion 100K are arranged in this order in the front-back direction from the front side to the back side.

The main body 110 is covered with a body casing 111 made of a synthetic resin and having a box shape. An ejection tray 111*b* is formed on a top surface 111*a* of the body casing 111. The ejection tray 111*b* is configured to receive a sheet P ejected from an ejection port 111*c*, which is formed in an upper portion on the back side of the body casing 111. A front-side opening 111*d* is formed on the front side of the body casing 111. The front-side opening 111*d* is opened by opening a front cover 111*e* toward the front side so that maintenance of components disposed inside, such as the yellow image formation portion 100Y, can be performed. The front cover 111*e* is pivotable about its lower end portion between open and closed positions.

A sheet supply cassette 120 is detachably attached to a bottom portion of the main body 110. The sheet supply cassette 120 is configured to support a stack of sheets P (recording media) therein.

A sheet pressing plate 122 on which sheets are loaded is disposed inside a cassette case 121 which contains the sheet supply cassette 120. The sheet pressing plate 122 is pivotable on a pressing plate rear end portion 122*a*, which is disposed on the back side, so that a pressing plate front end portion 122*b* vertically swings as a free end. A pressing plate raising lever 123 is disposed under the pressing plate front end portion 122*b* so as to urge it upward.

A separation pad 125 is disposed near the front-side end of the cassette case 121 and on a downstream side of the pressing plate front end portion 122*b* in a sheet feeding direction. A separation surface 125*a* is formed on an upper surface of the separation pad 125. A leading end of a sheet P being fed from the cassette case 121 in the sheet feeding direction contacts the separation surface 125*a*. The separation surface 125*a* is made of a material having a higher coefficient of friction than that of paper, such as a rubber. The separation pad 125 is urged upward by a separation pad urging spring 126.

A pinch roller 128 is disposed on an upper end of the cassette case 121 on the front side and on a downstream side of the separation pad 125 in the sheet feeding direction. The pinch roller 128 is rotatably supported by the cassette case 121.

Inside the main body 110 and above the sheet supply cassette 120, developing units 130 are detachably mounted. The developing units 130 include a yellow developing unit 130Y, a magenta developing unit 130M, a cyan developing unit 130C, and a black developing unit 130K, which are arranged in this order from the front side of the color laser printer 100 toward the back side. The yellow developing unit 130Y contains yellow powder toner, the magenta developing unit 130M contains magenta powder toner, the cyan developing unit 130C contains cyan powder toner, and the black developing unit 130K contains black powder toner.

Each developing unit 130 includes a developing unit case 131, a developing roller 132, a supply roller 133, an agitator 134, and a blade 135.

The developing unit case 131 is configured to support the developing roller 132, the supply roller 133, the agitator 134, and the blade 135, and to hold toner to develop an electrostatic latent image.

The developing roller 132 is made of rubber, and is rotatably supported by the developing unit case 131. The supply roller 133 is made of a sponge material, and is rotatably supported by the developing unit case 131. The developing roller 132 and the supply roller 133 are disposed in parallel and contact each other. The developing roller 132 and the supply roller 133 are configured to be rotated in a direction of the arrow indicated in FIG. 1, to charge toner at their contact portion, and to cause the charged toner to be carried on the circumferential surface of the developing roller 132.

The agitator 134 is configured to agitate toner in the developing unit case 131, and feed toner toward the supply roller 133. The agitator 134 is rotatably supported by the developing unit case 131.

The blade 135 is configured to regulate the amount of toner on the circumferential surface of the developing roller 132 by contacting the circumferential surface of the developing roller 132 when it is rotated in the direction of the arrow.

Drum units 140 are disposed along the front-back direction so as to face the corresponding developing rollers 132 of each developing unit 130.

Each drum unit 140 includes a photosensitive drum 141, a scorotron charger 142, a drum cleaner 143, and a drum unit frame 144.

The photosensitive drum 141 is configured so that an electrostatic latent image is formed on its circumferential surface. The photosensitive drum 141 is disposed to face the developing roller 132 of the developing unit 130. The scorotron charger 142 is disposed to face the circumferential surface of the photosensitive drum 141 on an upstream side of a position where the photosensitive drum 141 faces the developing roller 132 in a rotation direction of the photosensitive drum 141 (a direction of the arrow indicated in FIG. 1, herein after referred to as a drum rotation direction). The scorotron charger 142 is configured to uniformly charge the circumferential surface of the photosensitive drum 141. The drum cleaner 143 is disposed to face the circumferential surface of the photosensitive drum 141 on an upstream side of a position where the scorotron charger 142 faces photosensitive drum 141 in the drum rotation direction. The drum cleaner 143 is configured to clean the circumferential surface of the photosensitive drum 141 before being charged by the scorotron charger 142 along the longitudinal direction of the photosensitive drum 141 (or the width direction).

A scanner unit 150 is configured to generate and modulate a laser beam (indicated with a broken line in FIG. 1) based on image data at a laser emitting portion (not shown), and emit the laser beam onto the circumferential surface of the photosensitive drum 141 which is charged uniformly by the scorotron charger 142. That is, the scanner unit 150 is configured to scan the laser beam on the circumferential surface of the photosensitive drum 141 and form an electrostatic latent image on the circumferential surface of the photosensitive drum 141.

Inside the main body 110, a sheet feeding portion 160 for supplying a sheet P toward the developing units 130 and the drum units 140 is provided. The sheet feeding portion 160 is made up of a pickup roller 161, a separation roller 162, a sheet dust removing roller 163, a feed roller 164, and a sheet guide 165.

The pickup roller 161 is rotatably supported in the main body 1 10. The pickup roller 161 is configured to rotate in a direction of an arrow indicated in FIG. 1 via a power transmission mechanism provided in the main body 110. The pickup roller 161 is disposed to contact a sheet P, which is urged upward by the pressing plate front end 122*b* of the sheet pressing plate 122 and the pressing plate lifting lever 123, during image formation.

The separation roller 162 is rotatably supported in the main body 110. The separation roller 162 is configured to rotate in a direction of an arrow indicated in FIG. 1 via the power transmission mechanism provided in the main body 110. The separation roller 162 is disposed in contact with and applying pressure against the separation pad 125.

The sheet dust removing roller 163 is rotatably supported in the main body 110.

The sheet dust removing roller 163 is disposed ahead of the separation pad 125 in the sheet feeding direction so as to contact the pinch roller 128. The sheet dust removing roller 163 is configured to remove foreign matter such as paper dust and dirt from a sheet P by sandwiching the sheet P being fed with the pinch roller 128.

The feed roller 164 and the sheet guide 165 are disposed between the sheet dust removing roller 163 and the yellow image formation portion 100Y. The feed roller 164 and the sheet guide 165 are configured to guide a sheet P past the sheet dust removing roller 163 toward between the yellow image formation portion 100Y and a transfer portion 170.

The transfer portion 170 is disposed inside the main body 110 and under the image formation portions 100Y, 100M, 100C, 100K. The transfer portion 170 is made up of a sheet conveyor belt 171, transfer rollers 172, a belt drive roller 173, a belt support roller 174, and a belt cleaner 175.

The sheet conveyor belt 171 is formed as a circular belt made of a conductive plastic such as polycarbonate and polyimide, in which conductive particles, for example, carbon particles, are dispersed. The sheet conveyor belt 171 is stretched so that a conveyance-side surface 171*a*, which is an outer surface of the conveyor belt 171, faces the photosensitive drums 141.

The transfer rollers 172 are rotatably supported to face the respective photosensitive drums 141 via the sheet conveyor belt 171. The transfer rollers 172 are electrically connected to an output terminal of high voltage. A bias voltage is applied between each transfer roller 172 and the corresponding photosensitive drum 141 to transfer toner on the circumferential surface of the photosensitive drum 141 onto a sheet P being fed on the sheet conveyor belt 171.

The belt drive roller 173 is configured to rotate in a direction of an arrow in FIG. 1 via the power transmission mechanism provided in the main body 110. The belt drive roller 173 is disposed behind the photosensitive drum 141 facing the black developing unit 130K, which is disposed backmost in the developing units 130.

The belt support roller 174 is disposed before the photosensitive drum 141 facing the yellow developing unit 130Y, which is disposed foremost in the developing units 130. The sheet conveyor belt 171 is stretched between the belt drive roller 173 and the belt support roller 174 by a tension. When the belt drive roller 173 rotates in the direction of the arrow, the sheet conveyor belt 171 is moved around between the belt drive roller 173 and the belt support roller 174, and the belt support roller 174 is rotated.

The sheet conveyor belt 171 is supported by the belt drive roller 173 and the belt support roller 174 so that the conveyance-side surface 171*a* is movable below the image formation units 100Y, 100M, 100C, and 100K along their arrangement.

The belt cleaner 175 is disposed under the sheet conveyor belt 171 that is stretched below the transfer rollers 172. The belt cleaner 175 is configured to clean the conveyance-side surface 171*a* of the sheet conveyor belt 171 facing the image formation units 100Y, 100M, 100C, and 100K in the width direction.

A fixing portion 180 is disposed inside the main body 110 and downstream of the transfer portion 170 in the sheet feeding direction. The fixing portion 180 is configured to fix the toner image formed onto the sheet P. The fixing portion 180 includes a heat roller 181 and a pressure roller 182.

The heat roller 181 includes a roller body made of a metal thin tube whose surface is mold free, and a halogen lamp set inside the roller body. The heat roller 181 is configured to rotate in a direction of an arrow in FIG. 1 via the power transmission mechanism provided in the main body 110. The pressure roller 182 can be a silicone rubber roller disposed to press against the heat roller 181 by a pressure. The pressure roller 182 is configured to sandwich a sheet P with the heat roller 181, rotate along with the rotation of the heat roller 181, fix the toner image onto the sheet P, and feed the sheet P toward the ejection port 111*c*.

An ejection portion 190 is disposed backmost inside the main body 110 and above the fixing portion 180. The ejection portion 190 is configured to eject the sheet P passing the fixing portion 180 outside the main body 110.

The ejection portion 190 includes a feed roller 191, a pinch roller 192, sheet guides 193*a*, 193*b*, an ejection roller 194, and a driven roller 195.

The feed roller 191 and the pinch roller 192 are disposed downstream of the heat roller 181 and the pressure roller 182 in the sheet feeding direction. The feed roller 191 is supported to be rotated in a direction of an arrow indicated with a broken line in FIG. 1. The pinch roller 192 is disposed facing the feed roller 191. The pinch roller 192 is rotatably supported so as to follow the rotation of the feed roller 191. The feed roller 191 and the pinch roller 192 are configured to feed the sheet P on which the toner image has been fixed toward the ejection portion 111*c* along the rotation of the feed roller 191 in the direction of the arrow indicated with the broken line in FIG. 1.

The sheet guides 193*a* and 193*b* are formed on the downstream side of the feed roller 191 and the pinch roller 192 in the sheet feeding direction. The sheet guides 193*a* and 193*b* are configured to guide the sheet P being fed by the feed roller 191 and the pinch roller 192, toward a contact portion between the ejection roller 194 and the driven roller 195.

The ejection roller 194 and the driven roller 195 are disposed near the ejection port 111*c* to face the ejection port 111*c*. The ejection roller 194 is supported to be rotated in a direction of an arrow shown in FIG. 1. The driven roller 195 is disposed facing the ejection roller 194. The driven roller 195 rotatably supported so as to follow the rotation of the ejection roller 194. The ejection roller 194 and the driven roller 195 are configured to eject the sheet P on which the toner image has been fixed, from the ejection port 111*c* outside the main body 110, along with the rotation of the ejection roller 194 in the direction of the arrow indicated in FIG. 1.

Figure 2:
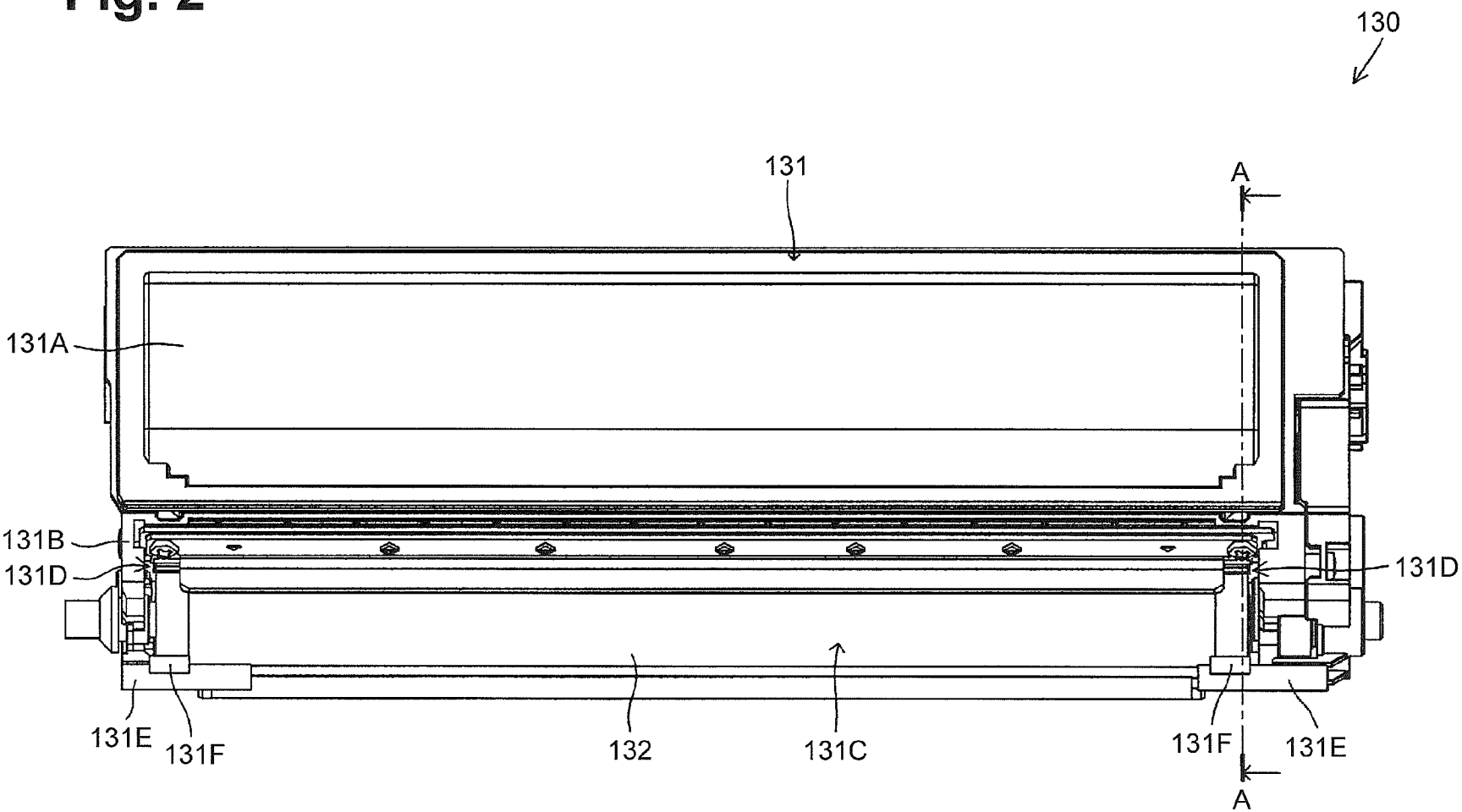
FIG. 2 is a plan view of a developing unit shown in FIG. 1.
Figure 3:
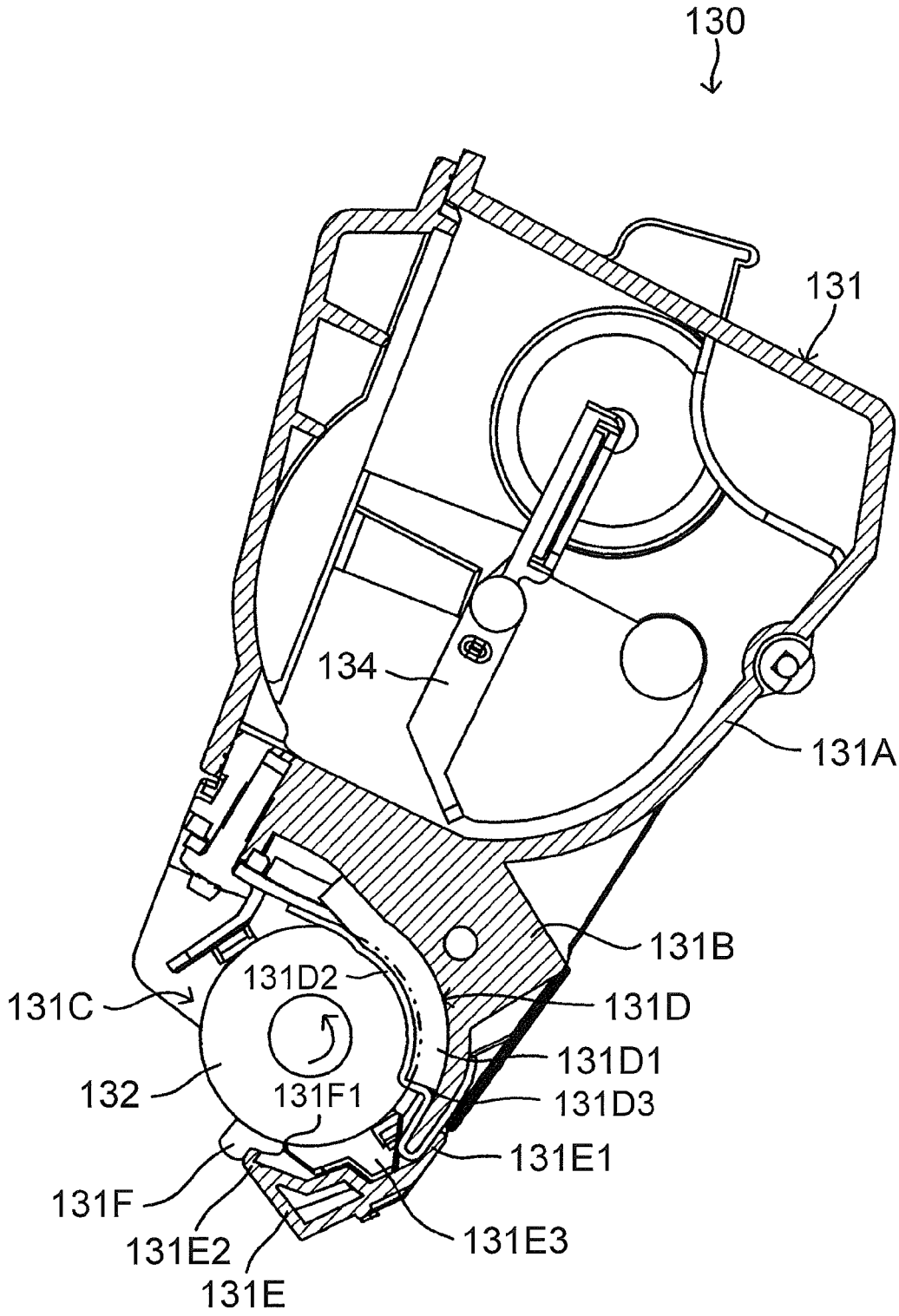
FIG. 3 is a sectional view of the developing unit taken along the line A-A of FIG. 2.

FIG. 2 is a plan view of one of the developing units 130 shown in FIG. 1. FIG. 3 is a sectional view of the developing unit 130 taken along the line A-A of FIG. 2. In FIG. 3, it is assumed that the developing unit 130 is mounted in the main body 110 of the color laser unit 100 as shown in FIG. 1.

Referring to FIGS. 2 and 3, the developing unit 130 includes a toner containing case 131A, and a roller support portion 131B. The toner containing case 131A constitutes a toner chamber in which toner is contained. Inside the toner containing case 131A, the agitator 134 is rotatably accommodated. The roller support portion 131B is configured to support the developing roller 132 and the supply roller 133 rotatably. The roller support portion 131B is formed with a developing roller exposure opening 131C. The developing roller 132 is rotatably supported at the developing roller exposure opening 131C and disposed so that more than half of the circumferential surface of the developing roller 132 is exposed outside of the developing unit case 131, along the longitudinal direction or the width direction, that is, the left-right direction of FIG. 2.

As shown in FIG. 3, a side seal member 131D1 and a felt member 131D2 are disposed in a seal portion 131D. The seal portion 131D is a gap formed between each end portion of the developing roller exposure opening 131C and each end portion of developing roller 132 in the width direction. The side seal member 131D1 may be made of a urethane sponge having relatively high rigidity. The side seal member 131D1 is bonded on a surface of the developing unit case 131 (or the roller support portion 131B) facing the seal portion 131D. The felt member 131D2 can be formed of a napped felt in which a fluorine-based synthetic resin is impregnated. The felt member 131D2 is bonded over the entire side seal member 131D1. The developing roller 132 is disposed to press against the side seal member 131D1 from above the felt member 131D2 at each end of the developing roller 132 in the width direction. Referring to a double dotted line in FIG. 3, the side seal member 131D1, the felt member 131D2, and the developing roller 132 are in pressing contact with each other.

As shown in FIG. 2, safeguard members 131E are disposed on both ends of the developing roller exposure opening 131C in the width direction. As shown in FIG. 3, the safeguard member 131E is fixed to a lower end of the roller support portion 131B to form a lower end of the developing unit 130 when the developing unit 130 is mounted in the main body 110. The safeguard member 131E is configured to prevent toner from leaking outside the developing unit 130 when toner leaks from the seal portion 131D during attachment to and detachment from the main body 110.

Specifically, a base end portion 131E1 of the safeguard member 131E is fixed to the lower end of the roller support portion 131B so as to pinch an end of the felt member 131D2 against the roller support portion 131B as shown in FIG. 3. An end portion 131E2 of the safeguard member 131E is disposed to protrude from the base end portion 131E1 toward an upstream side in the rotation direction of the developing roller 132 as indicated with an arrow in FIG. 3. A hollow portion 131E3 provided between the base end portion 131E1 and the end portion 131E2 is configured to collect toner which leaks from the seal portion 131D.

As shown in FIG. 2, toner intrusion stoppers 13IF are disposed to correspond with both ends of the developing roller 132 in the width direction. As shown in FIG. 3, a toner intrusion stopper 131F is fixed to the end portion 131E2 of the safeguard member 131E.

As shown in FIG. 3, the toner intrusion stopper 131F is disposed to contact the circumferential surface of each end of the developing roller 132 by a pressure on an upstream side, in the rotation direction of the developing roller 132, at a position where the side seal member 131D1 and the felt member 131D2 are in pressing contact with the developing roller 132. A space corresponding to the hollow portion 131E3 is provided between an upstream-side end portion 131D3 of the seal portion 131D in the rotation direction of the developing roller 132 and a downstream-side end portion 13F1 of the toner intrusion stopper 131 in the rotation direction of the developing roller 132. The toner intrusion stopper 131F can be formed of a urethane sponge.

Referring to FIGS. 2 and 3, the seal portion 131D (the side seal member 131D1 and the felt member 131D2) and the toner intrusion stopper 131F are disposed to overlap each other in the width direction.

Referring to FIG. 1, an image formation operation by the color laser printer 100 will be described.

When the pickup roller 161 is rotated in the direction of the arrow, a few of sheets P loaded in the cassette case 121 are fed toward the separation roller 162. The leading ends of the sheets P are fed in between the separation roller 162 and the separation pad 125. With the rotation of the separation roller 162 in the direction of the arrow, only an uppermost sheet P is fed toward the sheet dust removing roller 163. The sheet P from which dust has been removed by the sheet dust removing roller 163 is fed toward the transfer portion 170 via the feed roller 164 and the sheet guide 165.

When the agitator 134 is rotated, toner in the developing unit case 131 is agitated, and the toner is fed toward the supply roller 133. The toner fed to the supply roller 133 is fed to the developing roller 132 with the rotation of the supply roller 133 in the direction of the arrow. The toner is frictionally charged at a position where the developing roller 132 and the supply roller 133 are in contact with each other, and adheres to the circumferential surface of the developing roller 132. The toner adhering to the circumferential surface of the developing roller 132 is regulated to a specified density and charging amount by the blade 135, and then supplied to a position where the developing roller 132 faces the photosensitive drum 141.

The circumferential surface of the photosensitive drum 141 is charged uniformly by the scorotron charger 142, and irradiated with laser light modulated according to image information. Thus, an electrostatic latent image based on the image information is formed on the circumferential surface of the photosensitive drum 141. The circumferential surface of the photosensitive drum 141, on which the latent image is formed, faces the circumferential surface of the developing roller 132, and the toner adheres to the circumferential surface of the photosensitive drum 141. Thus, the latent image on the circumferential surface of the photosensitive drum 141 is developed with the toner.

The sheet P fed to the transfer portion 170 is carried on the sheet conveyor belt 171, and fed from the front to the back (from the right to the left in FIG. 1). When the sheet P is fed between the photosensitive drum 141 and the transfer roller 172 (hereinafter referred to as a transfer area), a bias voltage is applied to the transfer area, and the toner on the circumferential surface of the photosensitive drum 141 is transferred to the sheet P.

The sheet P to which the toner has adhered in the transfer portion 170 is fed to the fixing portion 180. The sheet P is pinched and heated between the heat roller 181 and the pressure roller 182, and the toner on the sheet P is melted and fixed onto the sheet P. Then, the sheet P is ejected to the ejection tray 111*b* outside the main body 110 by the ejection roller 194.

With reference to FIGS. 1 and 3, the following description will be made as to how to prevent toner that leaks (e.g., accidentally) from an end of one developing unit 130, in the width direction, from intruding into the remaining developing units 130.

In the following description, it is assumed that toner leaks from the seal portion 131D of the developing unit case 131 of the yellow developing unit 130Y.

In this case, the leaked toner adheres to an end of the circumferential surface of the developing roller 132 in the width direction. The leaked toner adhering to the end of the circumferential surface of the developing roller 132 adheres to an end of the circumferential surface of the photosensitive drum 141 in the width direction. The leaked toner adhering to the end of the circumferential surface of the photosensitive drum 141 is fed to the transfer area with the rotation of the photosensitive drum 141 in the direction of the arrow, and adheres to an end of the sheet conveyor belt 171 or the conveyance-side surface 171*a*, in the width direction, in the transfer area.

Alternatively, the leaked toner may drop to the end of the conveyance-side surface 171*a* of the sheet conveyor belt 171 disposed under the sealed portion 131D by gravitation and deposit in the end.

The leaked toner that is deposited in the end of the conveyance-side surface 171*a* of the sheet conveyor belt 171 is fed to the transfer area of the magenta image formation portion 100M as the conveyance-side surface 171*a* is moved in the direction of the arrow. In the transfer area, the end of the conveyance-side surface 171*a* where the leaked toner is deposited faces the photosensitive drum 141, which results in the toner adhering to the end of the photosensitive drum 141.

When the toner adheres to the end of the photosensitive drum 141 in the drum unit 140 that faces the magenta developing unit 130M, the toner is fed to the magenta developing unit 130M along with the rotation of the photosensitive drum 141 in the direction of the arrow.

The toner can be partially removed by the drum cleaner 143 provided in the drum unit 140. As is well known, the seal portion 131D is formed outside an image formation area of the photosensitive drum 141 in the width direction, and an area where the leaked toner adheres is determined outside the image formation area.

The drum cleaner 143 is designed on the assumption that it removes a small amount of toner or dust that is not transferred to the sheet P in the transfer area and remains in the image formation area. It is not assumed that the drum cleaner 143 completely removes all of a relatively large amount of toner adhering to the photosensitive drum 141 (especially outside the image formation area) such as the toner leaked as described above.

Thus, it can be difficult for the drum cleaner 143 to remove the leaked toner adhering to the end of the photosensitive drum 141 from the conveyance-side surface 171*a* of the conveyor belt 171 in the transfer area (that is, the toner inversely transferred from the conveyance-side surface 171*a* to the end of the photosensitive drum 141). As a result, a part of the leaked toner passes through the drum cleaner 143 and is fed to a position where the photosensitive drum 141 faces the end of the developing roller 143 in the magenta developing unit 130M. In this position, the leaked toner adheres to the end of the developing roller 132 in the magenta developing unit 130M.

In a configuration that does not include the toner intrusion stoppers 131F, the leaked toner enters the sealed portion 131D of the magenta developing unit 130M.

That is, the toner goes in between the end of the circumferential surface of the developing roller 132 and the felt member 131D2 in the magenta developing unit 130M, which causes a poor sealed state in the seal portion 131D of the magenta developing unit 130M. As a result, magenta toner leaks from the seal portion 131D.

However, according to the above configuration, the leaked toner adhering to the end of the developing roller 132 of the magenta developing unit 130M is removed by the toner intrusion stopper 131F. Thus, the leaked toner can be prevented from intruding the seal portion 131D of the magenta developing unit 130M.

According to the above configuration, if a toner leakage happens at an end of one developing unit 130 in the width direction, the toner leakage can be prevented from bringing about a chain reaction of toner leakage at the neighboring developing unit 130. A chain reaction of sealing trouble can be effectively contained.

While the invention has been described with reference to exemplary aspects, it is to be understood that the invention is not restricted to the particular forms shown in the foregoing exemplary aspects. Various modifications and alterations can be made thereto without departing from the scope of the invention.

While aspects of the invention are described in a color laser printer, it will be appreciated that these aspects may be applied to other image forming apparatus including, but not limited to, multi-function devices, scanners, facsimiles, copiers and the like.

Figure 4:
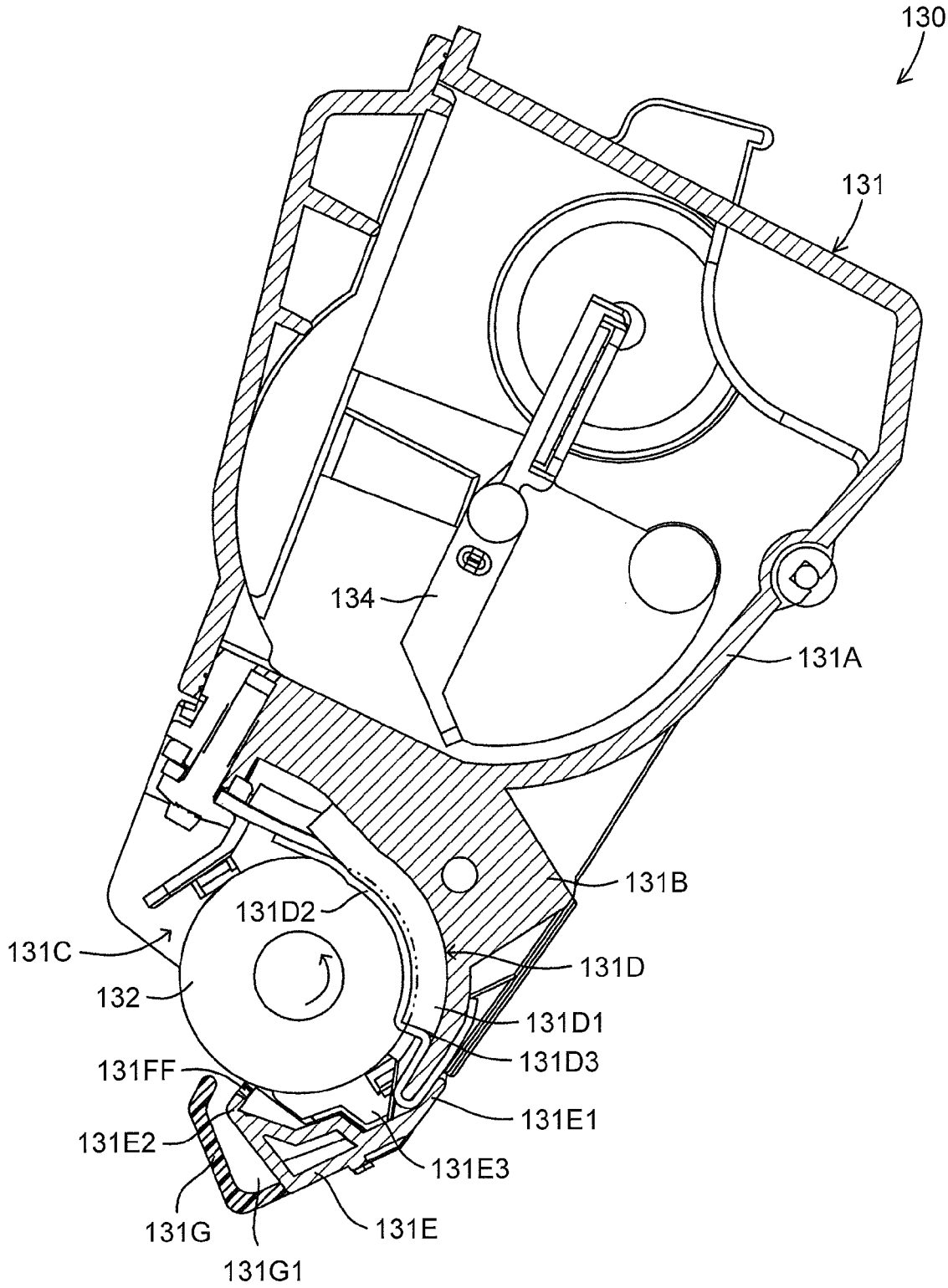
FIG. 4 is a sectional view of a developing unit according to another aspect.

The configuration of the toner intrusion stopper, which is configured to prevent toner from intruding in the seal portion 131D of the developing unit case 131 from outside, is not limited to that shown in FIG. 3. As shown in FIG. 4, for example, a toner intrusion stopper 131FF may be made of a plate member configured to scrape the leaked toner adhering to the end of the circumferential surface of the developing roller 132. The toner intrusion stopper 131FF is fixed to the end portion 131E2 of the safeguard member 131E. When the edge of the toner intrusion stopper 131FF contacts the end of the circumferential surface of the developing roller 132, the leaked toner adhering thereto is scraped.

In this case, a collecting member 131*g* may be provided to collect the leaked toner scraped by the toner intrusion stopper 131FF. The toner intrusion stopper 131FF is fixed to the safeguard member 131E. The collecting member 131g is formed with a recessed portion 131*g*1. The toner intrusion stopper 131FF is disposed so that the recessed portion 131*g*1 is open toward a contact portion between the developing roller 132 and the toner intrusion stopper 131FF.

According to the above configuration, if a large amount of toner leaks, a chain reaction of sealing trouble can be effectively prevented. In addition, the toner intrusion stopper 131FF and the collecting member 131*g* are provided in the developing unit 130 that is replaceable and can be attached to and removed from the main body 110 of the color laser printer 100. Thus, the leaked toner that is collected can be removed from the inside of the main body 110 at a specified time.

Figure 5:
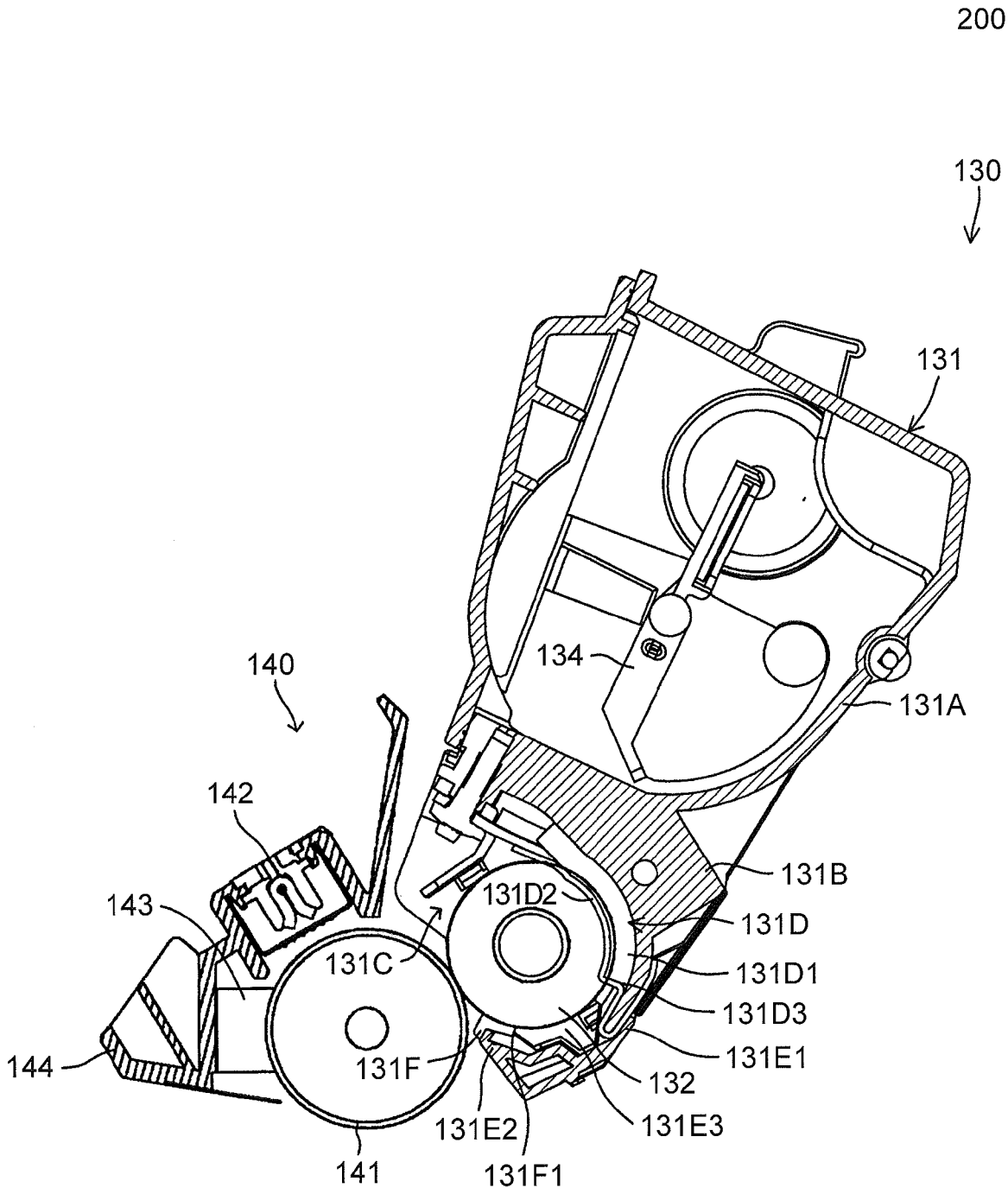
FIG. 5 is a sectional view of a structure of a process cartridge according to another aspect.

Each of the yellow image formation portion 100Y, the magenta image formation portion 100M, the cyan image formation portion 100C, and the black image formation portion 100K that are shown in FIG. 1 may be configured as a process cartridge 200 that is attachable to and detachable from the color laser printer 1 as shown in FIG. 5. Namely, the process cartridge 200 including the developing unit 130 and the drum unit 140 may be configured to be attached to and removed from the color laser printer 1.

In the process cartridge shown in FIG. 5, the developing unit 130 and the drum unit 140 may be separated from each other.

Figure 6:
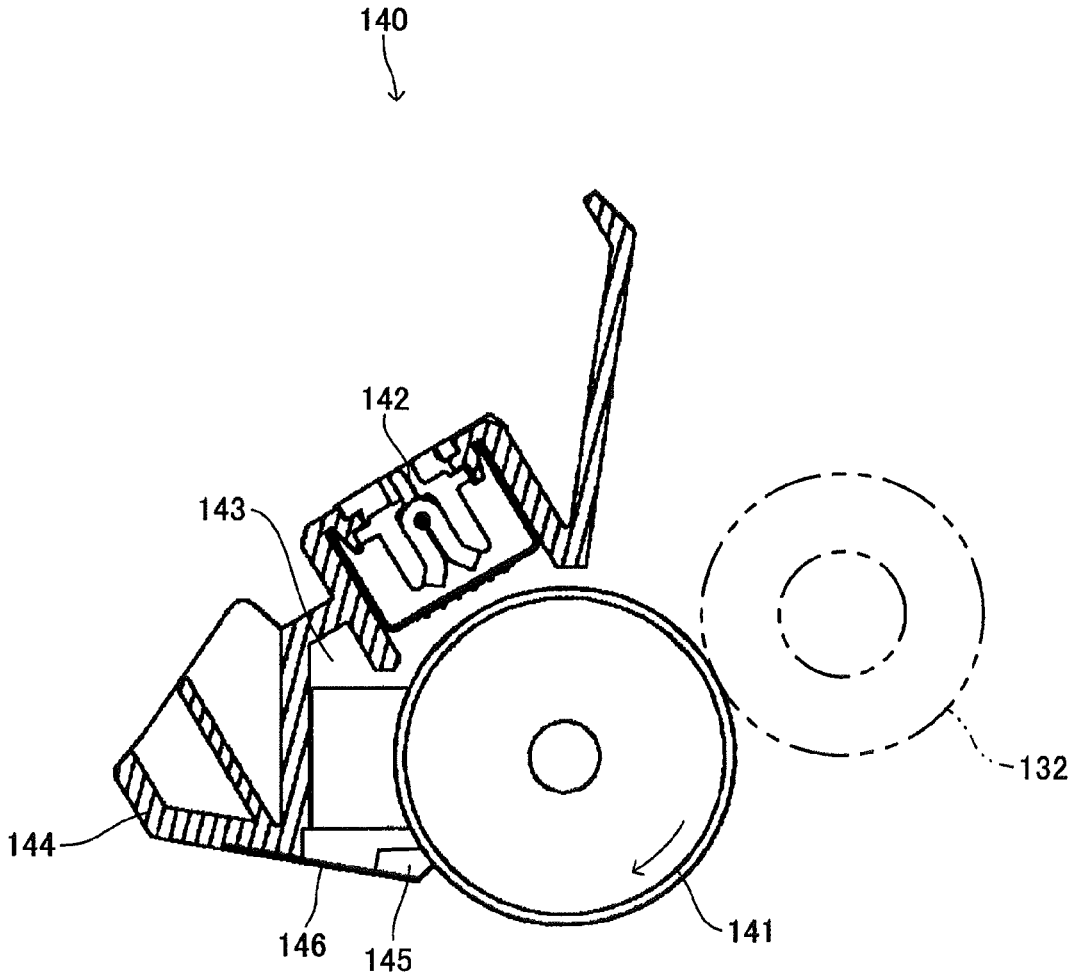
FIG. 6 is a sectional view of a structure of a drum unit according to another aspect.

As shown in FIG. 6, the drum unit 140 may include a drum end cleaner 145. The drum end cleaner 145 may be provided independently from a mechanism (the drum cleaner 143 in the above description) for removing toner adhering to the image formation area on the photosensitive drum 141 after toner has been transferred.

The drum end cleaner 145 is disposed in contact with the end of the circumferential surface of the photosensitive drum 141 on a downstream side of the transfer position in the rotation direction of the photosensitive drum 141. More specifically, the drum end cleaner 145 is supported by the drum unit frame 144 via a support member 146 that is made of a flexible plate member. The drum end cleaner 145 is disposed in contact with the end of the circumferential surface of the photosensitive drum 141 on an upstream side of a position where the photosensitive drum 141 faces the scorotron charger 142, in the rotation direction of the photosensitive drum 141.

The drum end cleaner 145 may be disposed in contact with the end of the circumferential surface of the photosensitive drum 141 on the upstream side of a position where the drum cleaner 143 faces the photosensitive drum 141 in the rotation direction of the photosensitive drum 141, as shown in FIG. 6. Alternatively, the drum end cleaner 145 may be disposed in contact with the end of the circumferential surface of the photosensitive drum 141 on a downstream side of the position where the drum cleaner 143 faces the photosensitive drum 141 in the rotation direction of the photosensitive drum 141.

The above modification may be applied to a configuration of a cleaner-less type, which omits the drum cleaner 143.

Figure 7:
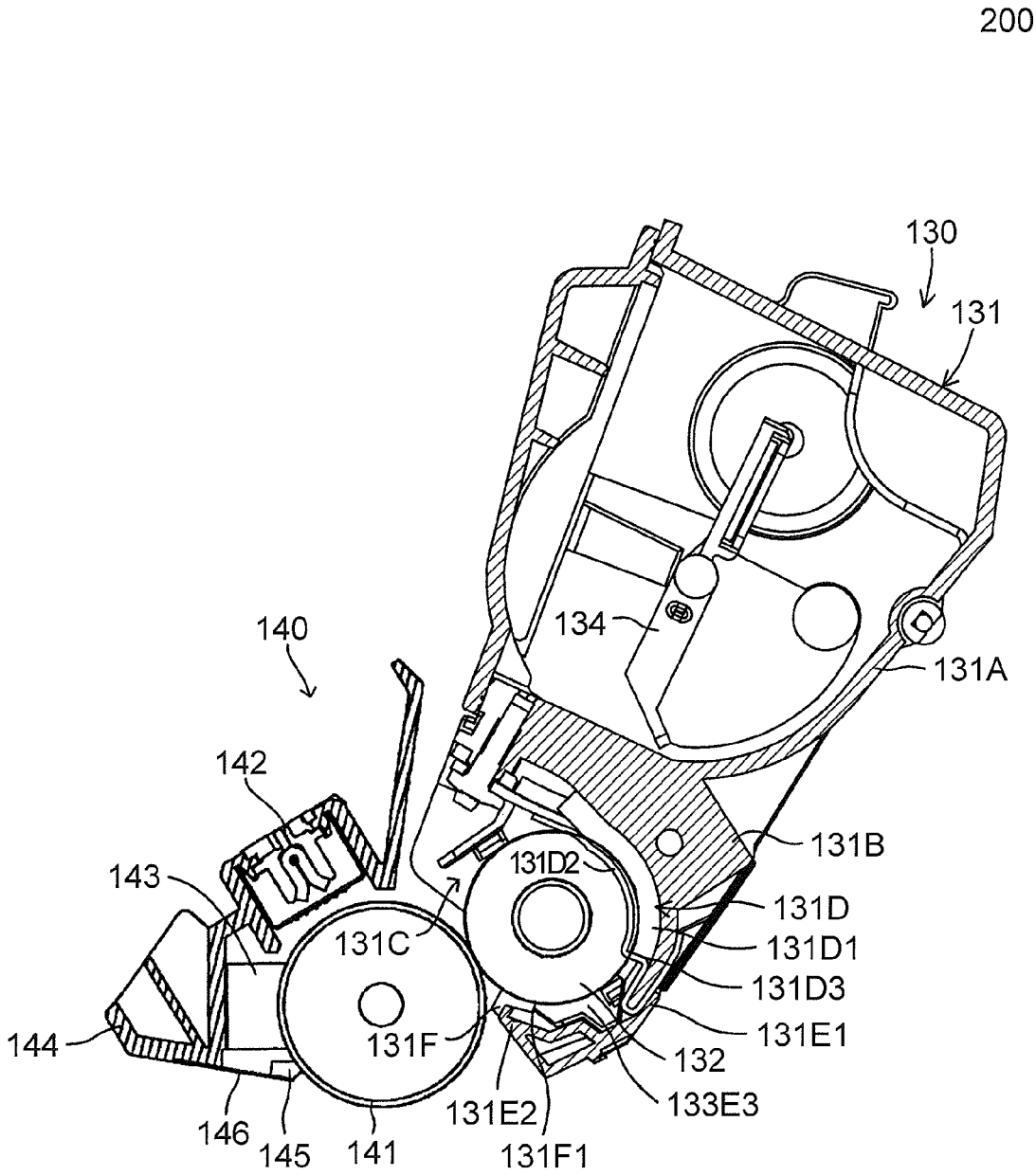
FIG. 7 is a sectional view of a structure of a process cartridge according to another aspect.

As shown in FIG. 7, the toner intrusion stopper 131F may be used in conjunction with the drum end cleaner 145. As described above, the developing unit 130 including the toner intrusion stopper 131F and the drum unit 140 including the drum end cleaner 145 may be configured as the process cartridge 200 (FIG. 5) that is attachable to and detachable from the main body 110 (FIG. 1) of the color laser printer 1.

Figure 8:
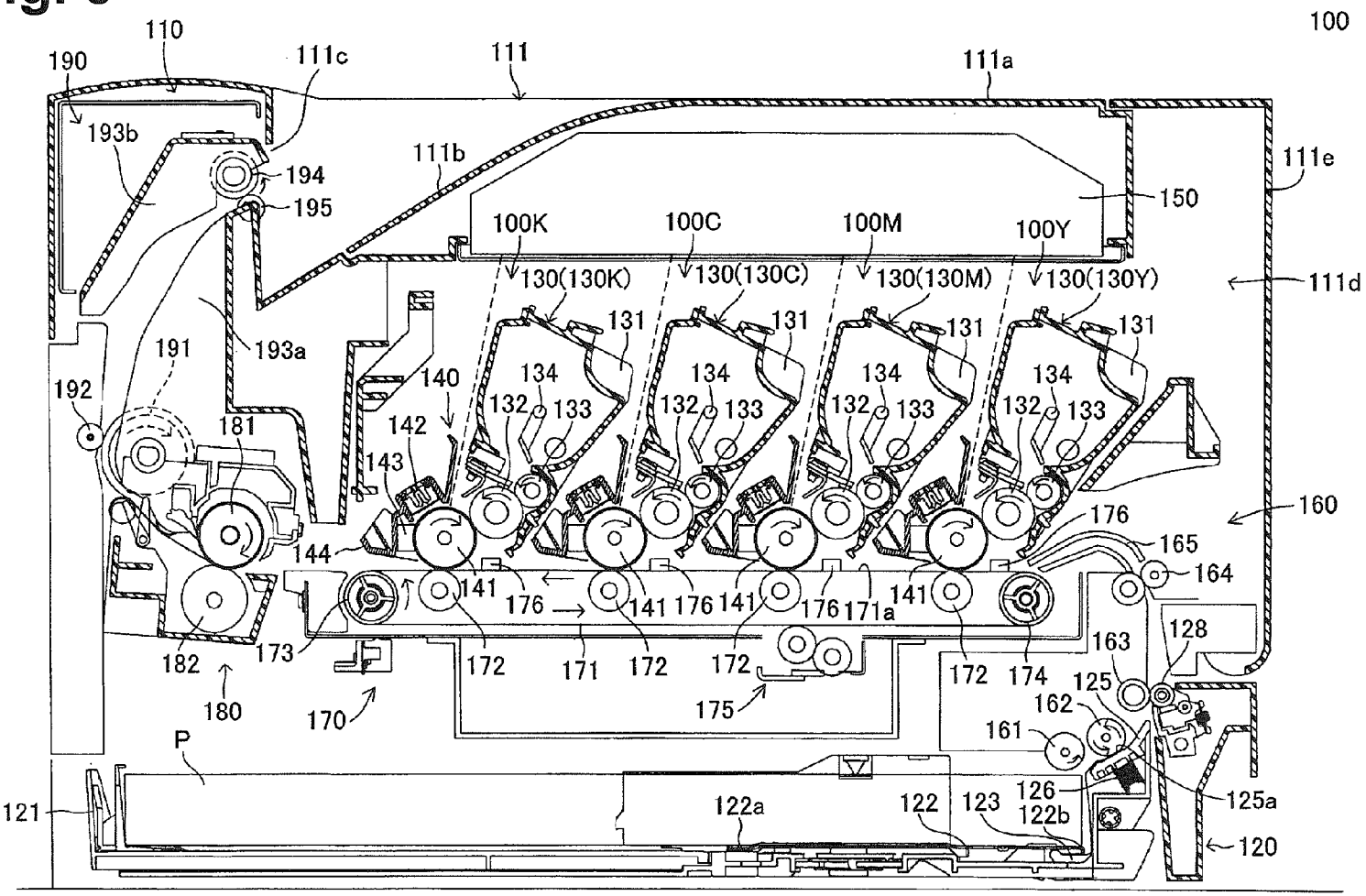
FIG. 8 is a sectional view showing an internal structure of a color laser printer according to another aspect.

As shown in FIG. 8, the transfer portion 170 may include belt end cleaners 176.

The belt end cleaners 176 are disposed between the adjacent image formation portions so as to face each end of the sheet conveyor belt 171 in the width direction. The belt end cleaners 176 are configured to remove the leaked toner adhering to the conveyance-side surface 171*a* of the conveyor belt 171.

According to the above configuration, the leaked toner can be removed from the conveyance-side surface 171*a* of the conveyor belt 171 before the leaked toner intrudes in the neighboring image formation portion disposed on a downstream side in the rotation direction of the sheet conveyor belt 171. Thus, a chain reaction of sealing trouble can be effectively prevented.

What is claimed is:

1. An image forming apparatus comprising:

a main body;

image formation units disposed in the main body, each image formation unit including:

a developing case extending in a first direction, the developing case being configured to hold developer therein, a developer carrier disposed in the developing case, the developer carrier configured to rotate and hold the developer on a circumferential surface thereof, and a pair of sealing members disposed in the developing case, each sealing member being disposed in a gap between the developing case and an end of the developer carrier in the first direction, each sealing member being configured to prevent developer from leaking outside the developing case;

a moving member disposed in the main body and including an opposing surface facing each of the image formation units, the moving member being configured to move in a second direction perpendicular to the first direction;

photosensitive members, each of which is disposed facing a corresponding developer carrier and configured to rotate and hold an electrostatic latent image on a circumferential surface thereof, wherein at least one of the image formation units includes a pair of first stoppers disposed in the developing case, each first stopper being disposed upstream of a corresponding one of the sealing members in a rotation direction of the developer carrier, and a pair of second stoppers, each second stopper being disposed upstream of and overlapping a corresponding one of the first stoppers in the rotation direction of the developer carrier.

2. The image forming apparatus according to claim 1, wherein the moving member is disposed below the plurality of image formation units.

3. The image forming apparatus according to claim 1, wherein each image formation unit further includes the pair of first stoppers and the pair of second stoppers.

4. The image forming apparatus according to claim 3, further comprising a pair of fourth stoppers, each disposed in contact with an end of the circumferential surface of the photosensitive member in the first direction.

5. The image forming apparatus according to claim 3, wherein each second stopper is configured to prevent the developer on the moving member from entering an image formation unit disposed downstream in the second direction.

6. The image forming apparatus according to claim 1, wherein each first stopper is disposed on a corresponding end of the developing case in the first direction, and each second stopper is fixed to an end of each first stopper.

7. The image forming apparatus according to claim 6, wherein each second stopper comprises a contact member configured to contact the circumferential surface of the developer carrier at an upstream side of a corresponding sealing member in the rotation direction of the developer carrier.

8. The image forming apparatus according to claim 7, wherein a downstream end of the contact member in the rotation direction is away from an upstream end of the corresponding sealing member in the rotation direction.

9. The image forming apparatus according to claim 1, further comprising a pair of third stoppers, each interposed between adjacent image formation units to face a lateral end of the moving member in the second direction.

10. The image forming apparatus according to claim 1, wherein the moving member includes a conveyor belt disposed facing the photosensitive members and is configured to feed a recording medium in the first direction.

11. A process unit comprising:

a photosensitive member configured to hold an electrostatic latent image on a circumferential surface thereof;

a developer carrier configured to hold a developer on a circumferential surface thereof, the circumferential surface of the developer carrier being elongated in a longitudinal direction thereof, the developer carrier disposed facing the photosensitive member;

a developing case configured to support the developer carrier;

a pair of sealing members disposed in the developing case, each sealing member being provided in a gap between the developing case and a corresponding end of the developer carrier in the longitudinal direction; and a pair of first stoppers disposed on both ends of the developing case in the longitudinal direction, each disposed upstream from a corresponding one of the sealing members in a rotation direction of the developer carrier; and a pair of second stoppers correspondingly fixed to the pair of first stoppers and upstream of and overlapping the first stoppers in the rotation direction of the developer carrier.

12. The process unit according to claim 11, wherein each second stopper comprises:

a contact member disposed on each end of the developer carrier in the longitudinal direction, the contact member being in contact with the circumferential surface of the developer carrier at an upstream side of a corresponding sealing member in the rotation direction of the developer carrier.

13. The process unit according to claim 12, wherein a downstream end of the contact member in the rotation direction is away from an upstream end of the corresponding sealing member in the rotation direction.

14. The process unit according to claim 11, further comprising:

a pair of third stoppers, each disposed in contact with an end of the circumferential surface of the photosensitive member in the longitudinal direction.

15. A developing unit comprising:

a developer carrier extending in a longitudinal direction, the developer carrier being configured to hold a developer on a circumferential surface thereof;

a developing case configured to support the developer carrier;

a pair of sealing members disposed in the developing case, each sealing member being provided in a gap between the developing case and a corresponding end of the developer carrier in the longitudinal direction; and a pair of first stoppers disposed in contact with the circumferential surface of the developer carrier at an upstream side of each sealing member in a rotation direction of the developer carrier; and a pair of second stoppers, each second stopper being disposed upstream of and overlapping a corresponding one of the first stoppers in the rotation direction of the developer carrier.

16. The developing unit according to claim 15, wherein each stopper comprises:

a contact member disposed in contact with the circumferential surface of the developer carrier, on a corresponding end of the developer carrier in the longitudinal direction.

17. The developing unit according to claim 16, wherein a downstream end of the contact member in the rotation direction is away from an upstream end of the sealing member in the rotation direction.

* * * * *